US010177431B2

(12) United States Patent
Zhang et al.

(10) Patent No.: US 10,177,431 B2
(45) Date of Patent: Jan. 8, 2019

(54) DIELECTRIC LOADED METALLIC RESONATOR

(71) Applicant: Radio Frequency Systems, Inc, Meriden, CT (US)

(72) Inventors: Yunchi Zhang, Wallingford, CT (US); Yin-Shing Chong, Middletown, CT (US); Gregory J. Lamont, Jackson, NJ (US)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 15/395,023

(22) Filed: Dec. 30, 2016

(65) Prior Publication Data

US 2018/0191046 A1 Jul. 5, 2018

(51) Int. Cl.

| | |
|---|---|
| ***H01P 7/04*** | (2006.01) |
| ***H01P 3/12*** | (2006.01) |
| ***H01P 1/205*** | (2006.01) |
| ***H01P 11/00*** | (2006.01) |
| ***H01P 1/208*** | (2006.01) |
| ***H01P 7/06*** | (2006.01) |

(52) U.S. Cl.

CPC ..... *H01P 7/04* (2013.01); *H01P 1/208* (2013.01); *H01P 1/2053* (2013.01); *H01P 3/12* (2013.01); *H01P 7/06* (2013.01); *H01P 11/002* (2013.01)

(58) Field of Classification Search

CPC .... H01P 1/205; H01P 7/04; H01P 7/06; H01P 11/002; H01P 1/208

USPC ..... 333/206, 207, 222–226

See application file for complete search history.

(56) References Cited

U.S. PATENT DOCUMENTS

| | | | | |
|---|---|---|---|---|
| 2,830,224 | A * | 4/1958 | Jenny | H01P 7/06 315/5.35 |
| 4,749,967 | A * | 6/1988 | Hoffman | H01P 1/125 200/520 |
| 5,008,640 | A | 4/1991 | Accatino et al. | |
| 5,612,655 | A | 3/1997 | Stronks et al. | |
| 5,874,870 | A | 2/1999 | Nishitama et al. | |
| 6,222,428 | B1 | 4/2001 | Akesson et al. | |
| 6,535,086 | B1 | 3/2003 | Liang et al. | |
| 6,600,394 | B1 | 7/2003 | Wang et al. | |
| 7,224,248 | B2 | 5/2007 | D'Ostilio | |
| 7,463,121 | B2 | 12/2008 | D'Ostilio | |
| 7,777,598 | B2 | 8/2010 | Salehi et al. | |
| 2002/0089397 | A1 | 7/2002 | Henningsson et al. | |
| 2006/0028305 | A1 * | 2/2006 | Dutta | H01P 3/084 333/238 |

(Continued)

FOREIGN PATENT DOCUMENTS

AU 2002300649 A1 3/2004

OTHER PUBLICATIONS

PCT International Search Report, PCT/US2017/067188, Intn'l Filing Date Dec. 19, 2017, dated Mar. 29, 2018, 4 pgs.

*Primary Examiner* — Rakesh Patel

(74) *Attorney, Agent, or Firm* — Mendelsohn Dunleavy, P.C.; Yuri Gruzdkov

(57) ABSTRACT

An apparatus, e.g. a cavity resonator, includes a floor and a cover. A conductive post is located between the floor and the cover and has a void oriented along a longitudinal axis of the post. A dielectric spacer is located between the cover and the post and a dielectric rod is located within the void. A resilient dielectric is located within the void between the dielectric spacer and the floor.

20 Claims, 3 Drawing Sheets

(56) References Cited

U.S. PATENT DOCUMENTS

| | | | |
|---|---|---|---|
| 2006/0038640 | A1 | 2/2006 | D'Ostilio |
| 2006/0284708 | A1 | 12/2006 | Reeves |
| 2012/0326811 | A1 | 12/2012 | Resnati et al. |
| 2015/0280302 | A1 | 10/2015 | Seo et al. |
| 2016/0261018 | A1 | 9/2016 | Shen et al. |

* cited by examiner

DIELECTRIC LOADED METALLIC RESONATOR

TECHNICAL FIELD

The present invention relates generally to the field of radio-frequency circuits, and more particularly, but not exclusively, to methods and apparatus for implementing a dielectric-loaded cavity resonator.

BACKGROUND

This section introduces aspects that may be helpful to facilitate a better understanding of the inventions. Accordingly, the statements of this section are to be read in this light and are not to be understood as admissions about what is in the prior art or what is not in the prior art. Any techniques or schemes described herein as existing or possible are presented as background for the present disclosure, but no admission is made thereby that these techniques and schemes were heretofore commercialized, or known to others besides the inventors.

Cavity resonators typically include a cavity enclosed by metal walls that confine electromagnetic fields, e.g. in the microwave region of the spectrum. The cavity may include a center electrode, sometimes referred to as a post. At a resonant frequency determined in part by the dimensions of the cavity, electromagnetic waves may resonate, forming standing waves in the cavity. Thus the cavity may act as a bandpass filter, allowing microwaves of a particular frequency to pass while blocking microwaves at other frequencies.

SUMMARY

The inventors disclose various apparatus and methods that may be beneficially applied to, e.g., optical communication systems such as metro and/or regional communications networks. While such embodiments may be expected to provide improvements in performance and/or security of such apparatus and methods, no particular result is a requirement of the present invention unless explicitly recited in a particular claim.

One embodiment provides an apparatus, e.g. a cavity resonator, that includes a floor and a cover. A conductive cylindrical post located between the floor and the cover includes a void oriented along a longitudinal axis, and a dielectric rod located within the void. A dielectric spacer is located between the cover and the cylindrical post. A resilient dielectric is located within the void between the dielectric spacer and the floor, and in some embodiments may be compressed between the floor and the cover to provide a restoring force that holds the dielectric spacer in place.

In some embodiments the dielectric rod includes a low-k dielectric such as poly(tetrafluoroethylene) (PTFE). In some embodiments the resilient dielectric is located between the floor and the dielectric rod. In some embodiments the resilient dielectric is an O-ring comprising an elastomeric material. In some embodiments the resilient dielectric includes a porous foam. Some embodiments further include an air gap between the dielectric rod and the floor. In some embodiments the resilient dielectric is located between the dielectric rod and the floor. In some embodiments the dielectric spacer comprises a ceramic material.

Another embodiment provides a method, e.g. of forming a cavity resonator. A cavity is provided that includes a floor, walls, and a conductive cylindrical post on the floor, the cylindrical post including a void oriented along a longitudinal axis of the post. The post includes a dielectric rod and a resilient dielectric within the void. The method further includes compressing the resilient dielectric by attaching a cover of the cavity to the walls, thereby applying a force on the dielectric rod.

Additional embodiments include methods, e.g. of forming a cavity resonator according to any of the apparatus described above.

Additional aspects of the invention will be set forth, in part, in the detailed description, figures and any claims which follow, and in part will be derived from the detailed description, or can be learned by practice of the invention. It is to be understood that both the foregoing general description and the following detailed description are exemplary and explanatory only and are not restrictive of the invention as disclosed.

BRIEF DESCRIPTION OF THE DRAWINGS

A more complete understanding of the present invention may be obtained by reference to the following detailed description when taken in conjunction with the accompanying drawings wherein.

DETAILED DESCRIPTION

Various embodiments are now described with reference to the drawings, wherein like reference numbers are used to refer to like elements throughout. In the following description, for purposes of explanation, numerous specific details are set forth in order to provide a thorough understanding of one or more embodiments. It may be evident, however, that such embodiment(s) may be practiced without these specific details.

In some implementations of a cavity resonator a dielectric spacer, or resonator, is placed between a central conductive rod and a wall of the cavity, e.g. a cover plate, to provide capacitive coupling between the rod and the wall. The relative permittivity, $\varepsilon_r$, of the resonator material, and a thickness of the resonator, may be selected to result in a desired value of capacitive coupling. Often, the dielectric spacer is designed with a large relative permittivity, e.g. 30-40, to provide strong coupling.

It is typically desirable to place the dielectric spacer in direct contact with both the central rod and the wall, i.e. to eliminate air gaps. When this is done, it may be desirable or necessary to secure the dielectric spacer to the central rod or to the cover plate during assembly.

Figure 1:
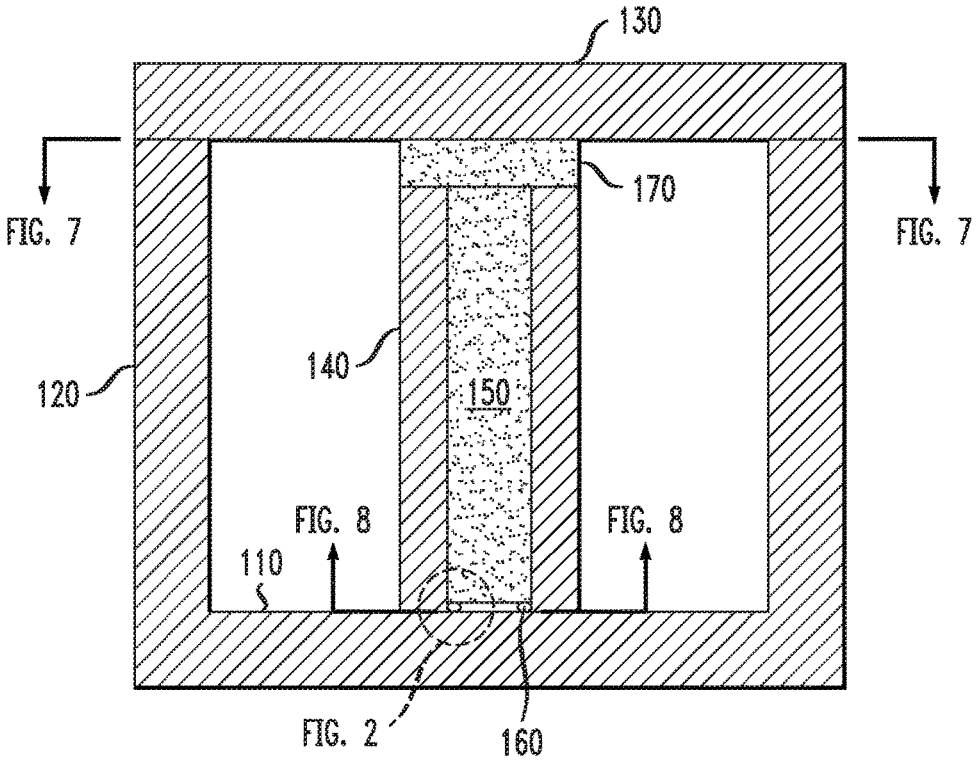
FIG. 1 illustrates a sectional view of a resonator cavity embodiment configured consistent with the disclosure, e.g. including floor and a cover, a cylindrical post electrode with a dielectric rod located within, and a resilient dielectric located between the floor and the dielectric rod that holds the dielectric rod in compression against a dielectric spacer located between the post electrode and the cover.
Figure 2:
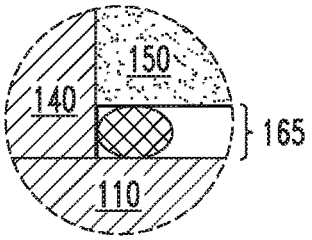
FIG. 2 presents a partial view of the embodiment of FIG. 1, detailing compression of the resilient dielectric between the dielectric rod and the cavity floor.
Figure 3:
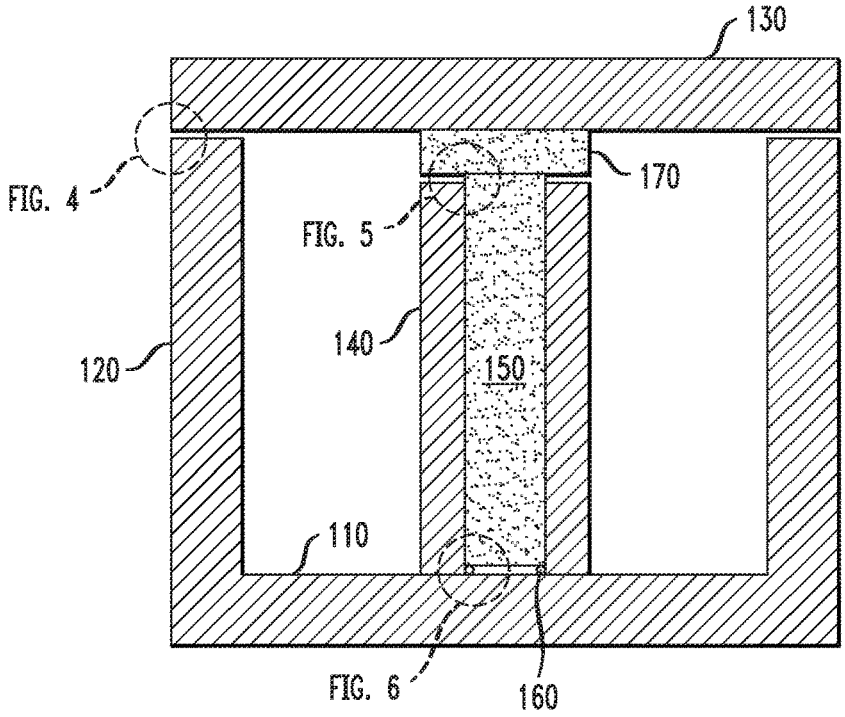
FIG. 3 presents a sectional view of the embodiment of FIG. 1 prior to attachment of the resonator cavity cover.
Figure 5:
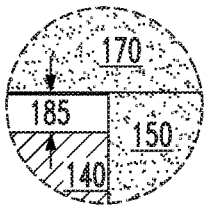
Figure 6:
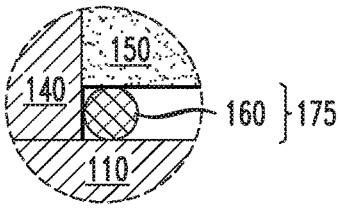
Figure 7:
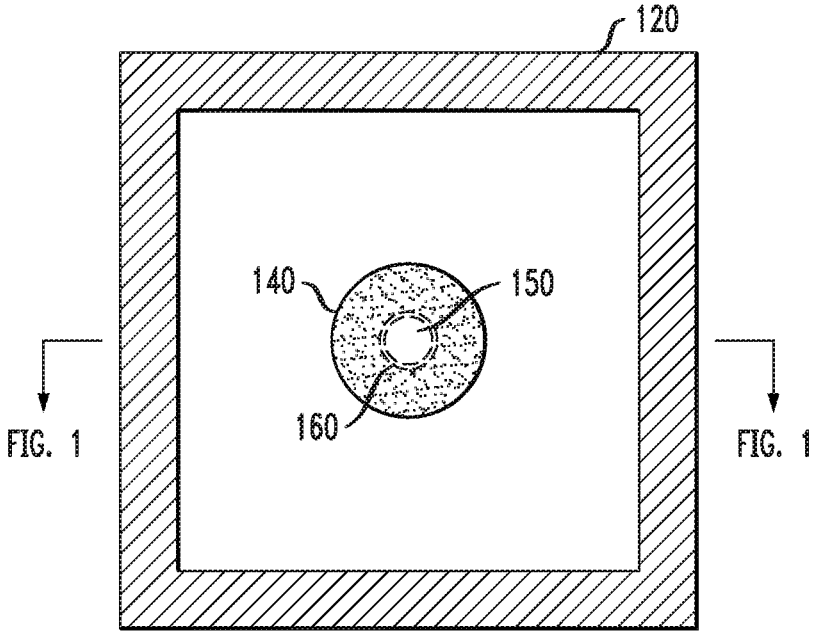
FIG. 7 presents a view of the embodiment of FIG. 1 toward the cavity floor, illustrating spatial relationships between the post electrode, the dielectric rod, and an O-ring acting as the resilient dielectric.
Figure 8:
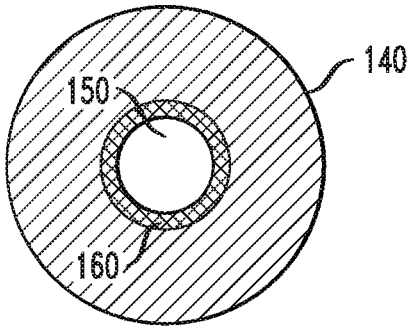
FIG. 8 presents a view of the embodiment of FIG. 1, toward the cover, further illustrating spatial relationships between the post electrode, the dielectric rod, and the O-ring.

Referring to FIGS. 1-8 throughout, an apparatus, e.g. a cavity resonator 100, is shown in various sectional views, the resonator 100 including a floor 110, walls 120 and a cover 130. FIG. 1 and FIG. 3 respectively show side-sectional views before and after attachment of the cover 130 to the walls 120. FIG. 7 shows a sectional view directed toward the floor 110, and FIG. 8 shows a sectional view directed toward the cover 130. FIGS. 2 and 4-6 provide various partial views of the illustrated embodiment. The floor 110 and walls 120 are shown as being assembled in multiple pieces, but embodiments are not limited to any particular type of assembly. The floor 110, walls 120 and cover 130 are conductive, and may preferably be formed from a metal such as copper. The cover 130 may be attached to the walls 120 by any means that provides a conductive connection therebetween, e.g. screws, soldering or brazing.

Referring to FIG. 1, within the cavity resonator 100 is located a cylindrical post 140. The cylindrical post 140 has a longitudinal axis oriented about normal to the floor 110, and an axial void oriented along the longitudinal axis. The sectional profile of the post normal to the longitudinal axis may be circular, but is not limited thereto. Located within the axial void is a dielectric rod 150 and a resilient dielectric 160. A dielectric spacer 170 is located between the dielectric rod 150 and the cover 130.

The resilient dielectric 160 is compressed between the dielectric rod 150 and the floor 110. The compressed resilient dielectric 160 holds the dielectric rod 150 away from the floor 110, resulting in a gap 165 between the floor 110 and the dielectric rod 150. The compression of the resilient dielectric 160 gives rise to a restoring force directed along the longitudinal axis of the dielectric rod 150, thereby holding the dielectric rod 150 in compression against the dielectric spacer 170. The dielectric spacer 170 is thereby held in compression between the cover 130 and the dielectric rod 150, effectively immobilizing the dielectric spacer 170.

Figure 9:
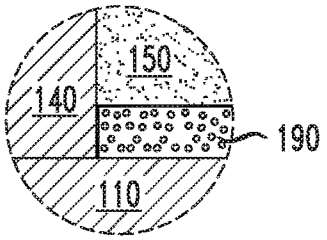
FIG. 9 presents a partial view of the embodiment of FIG. 1, detailing a foam dielectric located between the dielectric rod and the cavity floor and acting as the resilient dielectric.

The resilient dielectric 160 may be, for example, an O-ring as illustrated, but is not limited thereto. More generally, the resilient dielectric 160 is a compressible non-conductive material that when compressed by a compressive force provides an opposite restoring force. In the case of an O-ring, the resilient dielectric 160 may be formed from an elastomeric material such as, for example and without limitation, butyl rubber, fluoropolymer elastomer (e.g. Viton®), acrylonitrile butadiene rubber (e.g. Buna N®), and silicone rubber, such as molded liquid silicone rubber (LSR). While the O-ring in the illustrated embodiment is shown having a circular sectional profile when uncompressed, this is not a requirement. Thus the O-ring may have an uncompressed sectional profile that is, e.g. oval, square or rectangular. The resilient dielectric 160 may be other than an O-ring, e.g. an elastomeric foam. FIG. 9 shows such an embodiment, including an elastomeric dielectric foam 190, including distributed pores. Examples include, without limitation, polyethylene foam, polycholoroprene foam, latex foam, and vinyl nitrile rubber foam. In embodiments that include a foam, the foam may or may not fill the entire space between the dielectric rod 150 and the floor 110. Thus, for example, the resilient dielectric may be a ring-shaped spacer made from an elastomeric foam. If desired, the resilient dielectric may be a composite, e.g. a non-foam O-ring and a foam disk. Those skilled in the art will recognize that there are numerous variations of materials that may be used as the resilient dielectric 160 that fall within the scope of the description and the claims.

In the case of a resilient dielectric 160 that does not fill the space between the floor 110 and the dielectric rod 150, e.g. an O-ring, an air gap is present between the floor 110 and the resilient dielectric 160. In the case that the resilient dielectric 160 comprises an elastomeric foam, a portion of the volume between the floor 110 and the resilient dielectric 160 comprises open space, e.g. air space. Common to all embodiments consistent with the disclosure is that the volume between the floor 110 and the resilient dielectric 160 comprises a non-zero fraction of an elastomeric material and a non-zero fraction of open space, e.g. air space. The open space provides space into which the elastomeric material may deform when compressed by the compressive force imposed by the dielectric rod 150.

The dielectric rod 150 may comprise, and in some embodiments does comprise, a low-k dielectric material. In this context, "low-k" means the material has a relative dielectric permittivity of about 3 or less. Such materials may include, e.g., porous dielectrics and/or materials with inherently low relative dielectric permittivity, e.g. poly(tetrafluoroethylene) (PTFE).

The dielectric spacer 170 may comprise, and in some embodiments does comprise, a high-k dielectric material. In this context, "high-k" means the material has a relative dielectric permittivity of about 15 or more. Such materials may include, e.g., porous dielectrics and/or ceramic materials with inherently high relative dielectric permittivity, e.g. various compositions available from Trans-Tech, Inc., Woburn Mass., USA. The characteristics of the spacer 170, e.g. thickness and relative dielectric permittivity, are typically selected by the designer to result in a desired electrical characteristic of the cavity resonator 100. Such selection criteria are well known to those skilled in the pertinent art, and may include, e.g. cavity size, resonator quality, frequency sensitivity, material cost, and material manufacturability.

Figure 4:
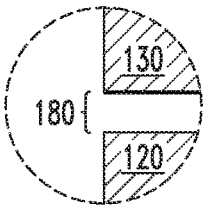
FIGS. 4-6 illustrate partial views of FIG. 3, detailing gaps between various components prior to attachment of the cover.

FIGS. 3-6 illustrate the resonator 100 prior to attachment of the cover 130 to the walls 120, i.e. prior to compression of the resilient dielectric 160. The dielectric rod 150 is shown in FIG. 6 resting on the resilient dielectric 160, shown without limitation as an O-ring, and a gap 175 between the dielectric spacer 170 and the cylindrical post 140 that is larger than the gap 165 after attaching the cover 130 to the walls 120. A similar gap 180 is shown in FIG. 4 between the cover 130 and the walls 120, and a similar gap 185 is shown in FIG. 5 between the dielectric spacer 170 and the cylindrical post 140. As illustrated in FIG. 6, the resilient dielectric 160 is uncompressed, other than such compression that may result from the force of gravity on the dielectric rod 150 against the resilient dielectric 160. In various embodiments, the gaps 175, 180 and 185 are about equal, but this is not a requirement unless specifically recited in a claim.

As described earlier, when the cover 130 is fastened to the walls 120, the resilient dielectric 160, e.g. O-ring or foam, is compressed, leaving an air gap in the form of an open space (e.g. in the case of the O-ring) or distributed pores (e.g. in the case of the foam). Without limitations, the primary purpose of the air gap is to provide space into which the resilient dielectric 160 can deform under compression. Because the air gap is located within the cylindrical post 140, its presence is not expected to affect the electrical characteristics of the resonator 100. The compressive force between the dielectric spacer 170 and the cover 130, and between the dielectric spacer 170 and the dielectric rod 150, may be determined in part by the thickness and material type of the resilient dielectric 160. It is noted that it is the force of the dielectric rod 150 against the dielectric spacer 170 that holds the dielectric spacer 170 against the cover 130. However, in various embodiments it may be preferred that the characteristics of the resilient dielectric, e.g. thickness and material type, be selected such that the gap 185 is eliminated when the cover 130 is attached to the walls 120. This selection typically cannot be determined a priori for all embodiments, as the material requirements are expected to be influenced by other design factors, such as the diameter of the void within the cylindrical post 140. It is further noted that while it may be preferred that the gap 185 be eliminated, this is not a requirement of any embodiment unless specifically claimed. Finally, it is not a requirement that the gap 180 between the cover 130 and the walls 120 be eliminated unless specifically recited in the claims. Thus embodiments within the scope of the description include the cavity resonator 100 prior to attachment of the cover 130 to the walls 120.

Herein and in the claims, the term "provide" with respect to an optical transmission system encompasses designing or fabricating the system, causing the system to be designed or fabricated, and/or obtaining the system by purchase, lease, rental or other contractual arrangement.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they formally fall within the scope of the claims.

The description and drawings merely illustrate the principles of the invention. It will thus be appreciated that those of ordinary skill in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Although multiple embodiments of the present invention have been illustrated in the accompanying Drawings and described in the foregoing Detailed Description, it should be understood that the present invention is not limited to the disclosed embodiments, but is capable of numerous rearrangements, modifications and substitutions without departing from the invention as set forth and defined by the following claims.

The invention claimed is:

1. An apparatus, comprising:

a cavity having a floor and a cover;

a conductive cylindrical post having a void oriented along a longitudinal axis;

a dielectric spacer located between said cover and said post;

a dielectric rod located within said void; and a resilient dielectric located within said void between said dielectric spacer and said floor; and wherein said resilient dielectric is an "O" ring comprising an elastomeric material.

2. The apparatus of claim 1, wherein said dielectric rod comprises polytetrafluoroethylene.

3. The apparatus of claim 1, wherein said resilient dielectric is located between said floor and said dielectric rod.

4. The apparatus of claim 1, wherein said cover and floor hold said resilient dielectric in compression.

5. The apparatus of claim 4, wherein said dielectric spacer and said post are immobilized between said cover and said floor by said compression.

6. The apparatus of claim 1, further comprising an air gap between said dielectric rod and said floor.

7. The apparatus of claim 1, wherein said resilient dielectric comprises a porous foam.

8. The apparatus of claim 1, wherein said dielectric spacer comprises a ceramic material.

9. An apparatus, comprising:

a cavity having a floor and a cover;

a conductive cylindrical post having a void oriented along a longitudinal axis;

a dielectric spacer located between said cover and said post;

a dielectric rod located within said void; and a resilient dielectric located within said void between said dielectric spacer and said floor; and wherein said resilient dielectric comprises a porous foam.

10. A method, comprising:

providing a cavity having a floor and walls, and a conductive cylindrical post on said floor having a void oriented along a longitudinal axis of said post, said post including a dielectric rod and a resilient dielectric within said void; and compressing said resilient dielectric by attaching a cover of the cavity to the walls, thereby applying a force on said dielectric rod; and wherein said resilient dielectric comprises a porous foam.

11. A method, comprising:

providing a cavity having a floor and walls, and a conductive cylindrical post on said floor having a void oriented along a longitudinal axis of said post, said post including a dielectric rod and a resilient dielectric within said void; and compressing said resilient dielectric by attaching a cover of the cavity to the walls, thereby applying a force on said dielectric rod; and wherein said resilient dielectric is an "O" ring comprising an elastomeric material.

12. The method of claim 11, wherein said force is applied to said dielectric rod through a dielectric spacer between said dielectric rod and a top of said cavity.

13. The method of claim 11, wherein said resilient dielectric is located between said floor and said dielectric rod.

14. The method of claim 11, wherein said dielectric rod comprises a low-k dielectric material.

15. The method of claim 14, wherein a dielectric spacer is located between said cover and said post, and said dielectric spacer is immobilized between said cover and said floor by said force.

16. The method of claim 11, wherein said compressing comprises deforming said resilient dielectric into an air gap between said dielectric rod and said floor.

17. The method of claim 11, wherein said resilient dielectric comprises a porous foam.

18. The method of claim 11, wherein said dielectric spacer comprises a ceramic material.

19. An apparatus, comprising:

a cavity having a floor and a cover;

a conductive cylindrical post having a void oriented along a longitudinal axis;

a dielectric spacer located between said cover and said post;

a dielectric rod located within said void; and a resilient dielectric located within said void between said dielectric spacer and said floor;

wherein said resilient dielectric is compressed between said floor and a bottom surface of said dielectric rod, thereby applying a force to said dielectric rod; and wherein said dielectric spacer is immobilized between said cover and a top surface of said dielectric rod by said force.

20. The apparatus of claim 19, wherein the top surface of said dielectric rod is in contact with said dielectric spacer.

* * * * *